US012560159B2

(12) United States Patent
Jakobi

(10) Patent No.: US 12,560,159 B2
(45) Date of Patent: Feb. 24, 2026

(54) TUBE ROLLER PUMP

(71) Applicant: B. Braun Avitum AG, Melsungen (DE)

(72) Inventor: Marco Jakobi, Uder (DE)

(73) Assignee: Braun Avitum AG, Melsungen (DE)

( * ) Notice: Subject to any disclaimer, the term of this patent is extended or adjusted under 35 U.S.C. 154(b) by 0 days.

(21) Appl. No.: 18/733,290

(22) Filed: Jun. 4, 2024

(65) Prior Publication Data

US 2024/0410353 A1 Dec. 12, 2024

(30) Foreign Application Priority Data

Jun. 7, 2023 (DE) ..... 10 2023 115 055.3

(51) Int. Cl.
*F04B 43/12* (2006.01)

(52) U.S. Cl.
CPC ..... *F04B 43/1253* (2013.01)

(58) Field of Classification Search
CPC .... A61M 1/14; A61M 60/113; A61M 60/279; F04B 43/1253; F04B 43/1276
See application file for complete search history.

(56) References Cited

U.S. PATENT DOCUMENTS 3,700,361 A * 10/1972 De Vries ..... F04B 43/1253 417/477.8
3,955,902 A * 5/1976 Kyvsgaard ..... F04B 43/1253 417/477.3
3,963,023 A * 6/1976 Hankinson ..... F04B 43/1276 604/153
4,174,193 A * 11/1979 Sakakibara ..... F04B 43/1253 417/477.8

(Continued)

FOREIGN PATENT DOCUMENTS

DE 102019133969 A1 6/2021
EP 1749549 B1 2/2007

OTHER PUBLICATIONS

Search Report received in German Application No. 24179558.2-1004 dated Oct. 4, 2024, with translation, 12 pages.

(Continued)

*Primary Examiner* — Jesse S Bogue
(74) *Attorney, Agent, or Firm* — Christopher A. Rothe; CM Law

(57) ABSTRACT

A peristaltic pump for extracorporeal blood treatment has a pump housing that accommodates a rotor. The rotor is rotatable about a rotor axis. The pump also includes at least two squeeze elements offset in a circumferential direction to each other. The pump housing has a support surface extending arc-shaped about the rotor axis and spaced radially from the rotor. The support surface is configured to support a tube segment inserted radially between the rotor and the support surface. In order to simplify the manual unthreading of the tube segment and thereby largely protect the tube segment, the peristaltic pump has a sliding edge arranged adjacent to the respective squeeze element against the rotational direction of the rotor, extends toward the support surface, is connected to the rotor in a rotationally fixed manner, and can be gripped from below by, or under reached by, the inserted tube segment.

10 Claims, 5 Drawing Sheets

(56) References Cited

U.S. PATENT DOCUMENTS 4,544,329 A * 10/1985 O'Boyle ..... F04B 43/12 417/477.4
4,558,996 A * 12/1985 Becker ..... F04B 43/1253 417/374
5,062,775 A * 11/1991 Orth ..... A61M 60/554 417/477.3
6,494,692 B1 * 12/2002 Green ..... F04B 43/0072 417/477.1
6,733,476 B2 * 5/2004 Christenson ..... F04B 43/1276 604/151
6,736,617 B2 * 5/2004 Domroese ..... A61M 60/113 417/477.3
9,328,726 B2 * 5/2016 Tujula ..... F04B 43/1284
9,717,890 B2 8/2017 Holper et al.
10,046,104 B2 * 8/2018 Matsuo ..... A61M 60/554
10,359,037 B2 * 7/2019 Yaeguchi ..... F04B 43/1269
10,982,666 B2 * 4/2021 Winking ..... F04B 43/1261
11,639,716 B2 * 5/2023 Bückle ..... F04B 53/00 417/477.3
2015/0159643 A1 * 6/2015 Koob ..... F04B 43/12 417/474
2023/0041478 A1 * 2/2023 Spengler ..... A61M 60/37

OTHER PUBLICATIONS

Search Report received in German Application No. 10 2023 115 055.3 dated Mar. 4, 2024, with translation, 10 pages.

* cited by examiner

Position 2

Position 1

TUBE ROLLER PUMP

CROSS-REFERENCE TO RELATED APPLICATION

This application claims priority under 35 U.S.C. § 119 to German Application No. 10 2023 115 055.3, filed on Jun. 7, 2023, the content of which is incorporated by reference herein in its entirety.

FIELD

The present disclosure relates to a tube roller pump or peristaltic pump, resp., i.e. a positive displacement pump, in which the medium to be conveyed is forced through a tube by external mechanical deformation of the tube.

BACKGROUND

Such pumps are frequently used for conveying fluid, in particular blood, in a device for extracorporeal blood treatment, in particular in a dialysis machine. The fluid is conveyed via the peristaltic pump from a low-pressure side to a high-pressure side, wherein an elastically deformable fluid line arranged between the low-pressure side and the high-pressure side in the form of a tube segment, which is referred to as a pump segment, is deformed, in particular squeezed, between a support surface of a pump bed and a rotor with at least two squeeze elements rotating relative thereto.

In a known peristaltic pump, as known for example from the document EP 1 749 549 B1, two squeeze elements 320 diametrically offset from each other in the form of spring-mounted pinch rollers are provided on the rotor 310—as shown schematically in FIGS. 8 to 11—and the support surface 330 is formed by a circular segment area which extends over a sufficiently large central angle WZS greater than 180°.

For additional fixation of the tube segment 340 inserted into the peristaltic pump, i.e. into the pump bed (see FIG. 11), there is a guide surface 350 in the center between the two pinch rollers 320, which is configured like a segment of a circle and extends over a central angle WZF (see FIG. 10) of approximately 30°. Running before the guide surface 350, the rotor 310 carries a pair of leading guiding projections 360, which are of plate-like design and extend radially into the vicinity of the support surface 330, so that the tube segment 340 is axially trapped between the guiding projections 360. An edge 370 is formed at the leading end of the guiding projections 360, which is used as follows during manual unthreading of the tube segment 340:

When the tube segment 340—as shown in FIG. 11—is to be unthreaded from the housing of the peristaltic pump, there is a risk with the known peristaltic pump that the tube segment 340 will be jammed when the rotor 310 assumes an unfavorable rotational position. FIG. 11 shows such a state. The edges 370 formed on the guiding projections 360 can only be used sensibly for unthreading the tube segment 340 if the rotor 310 is in rotational orientations that lie between the positions shown in FIG. 9 and FIG. 10. In other words, the person operating the peristaltic pump only has a limited angle window FW (see FIG. 10) of less than 90° available for unthreading the tube segment, in which the probability of clamping of the tube segment 340 is lower.

SUMMARY

The object of the present disclosure is therefore to further develop the generic peristaltic pump in such a way that unthreading of the tube segment accommodated in the peristaltic pump is simplified, whereby the tube segment is to be protected as far as possible from damage.

The proposed peristaltic pump is characterized by a sliding edge arranged adjacent to the respective squeeze element against the rotational direction of the rotor and extending toward the support surface, wherein the sliding edge is connected to the rotor in a rotationally fixed manner and can be gripped from below or is under reached, resp., by the inserted tube segment. Due to the innovative arrangement or assembly of the sliding edge, the pulling movement on the tube segment during manual removal or unthreading of the tube segment causes the rotor to rotate even with very small pulling forces, which reliably prevents clamping of the tube between the squeeze element and the pump bed. The tensile and frictional forces exerted on the tube segment are thus reduced, making it possible to handle the tube segment very gently during the unthreading process. This results in the additional advantage that, due to the proximity of the sliding edge to the squeeze elements or pinch rollers, the area is larger in which the rotor has to be located during manual unthreading in order to avoid clamping of the tube, so that the unthreading of the tube segment is simplified overall.

The sliding edge may be arranged on a wide variety of components of the peristaltic pump. The decisive factor is that it is located on a component that is connected to the rotor in a rotationally fixed manner, so that the force exerted on the sliding edge by the tube segment can set the rotor in rotation. Advantageously, the sliding edge is either a component of a rotor body, or of a swing arm connected to the rotor in a rotationally fixed manner, or of a rotor cover with a cover plate overlapping the squeeze elements.

The lower the sliding edge is, i.e. the closer the sliding edge is to the pump bed, the earlier the tube segment comes into contact with it during unthreading. It is therefore advantageous if the cover plate of the rotor cover thickens in the circumferential direction against the rotational direction to form the sliding edge.

An assembly that is particularly easy to produce is one where the cover plate has a downward angled border bar to form the sliding edge.

Advantages with regard to mounting of the squeeze elements can be achieved when the border bar merges at its radially outermost end into a circumferential edge portion, the height of which gradually decreases toward the squeeze element.

Preferably, the sliding edge is formed and/or coated with a material that has abrasion-minimizing sliding properties.

BRIEF DESCRIPTION OF THE DRAWINGS

Configuration examples of the present disclosure are explained in more detail below with reference to schematic drawings.

DETAILED DESCRIPTION

FIGS. 1 to 6 show a peristaltic pump as used in dialysis machines, for example. The object of the peristaltic pump is to convey a defined volume of a medium, such as blood or dialysis fluid, by deforming and clamping the elastically deformable fluid line. The peristaltic pump for pumping blood generally pumps from a negative pressure side PN (low-pressure side) to a positive pressure side PP (high-pressure side).

Figure 1:
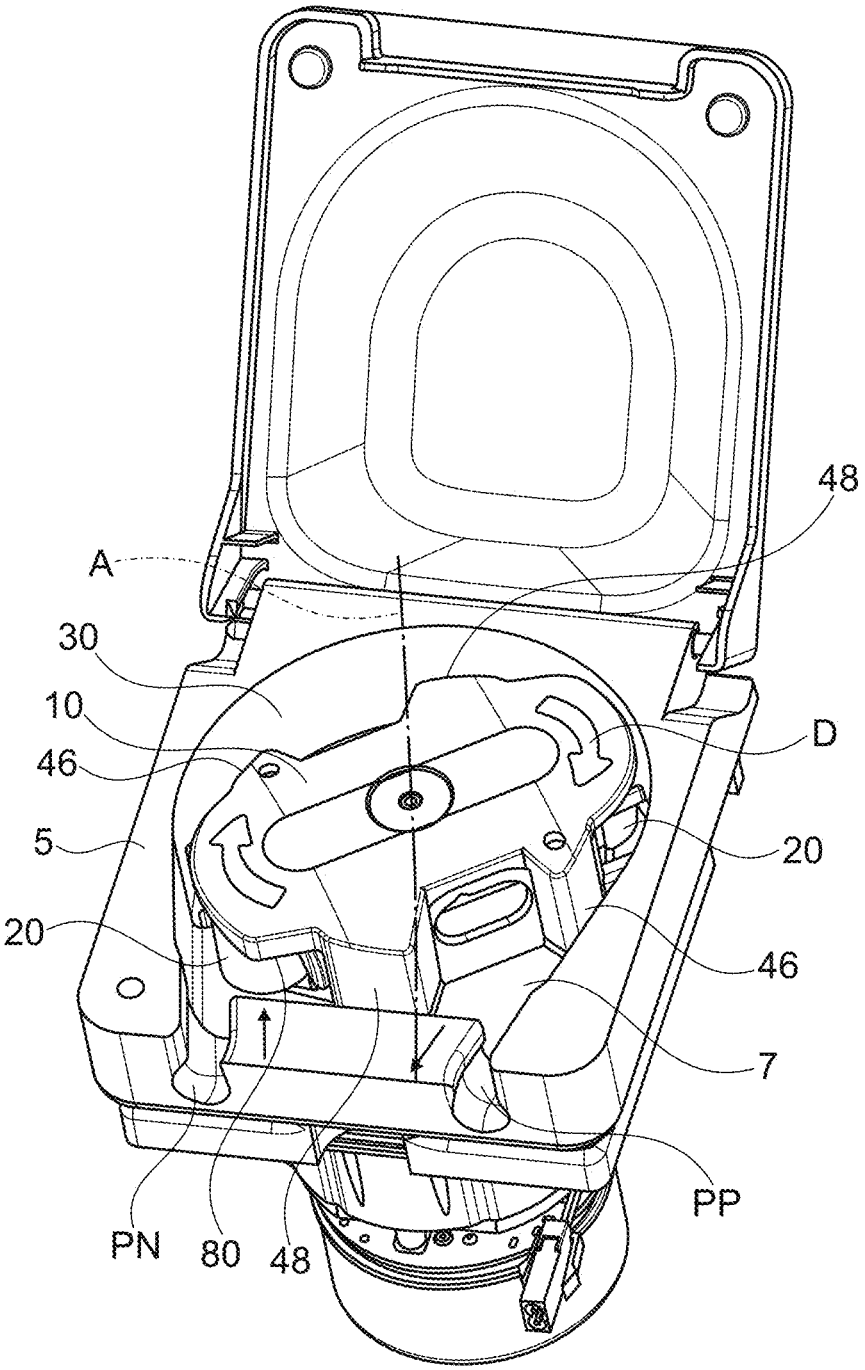
FIG. 1 shows a perspective representation of an exemplary embodiment of a peristaltic pump as it can be used in connection with a device for extracorporeal blood treatment.

As shown in FIG. 1, the peristaltic pump has a pump housing 5, in which a rotor 10 rotatable about a rotor axis A with at least two squeeze elements 20, here pressure rollers, for example diametrically offset in a circumferential direction to each other, is accommodated and which has a support surface 30 extending arc-shaped around the rotor axis A and radially spaced from the rotor 10, wherein the support surface 30 is configured for radially supporting a tube segment—not shown in FIG. 1—which can be inserted radially between the rotor 10 and the support surface 30. The squeeze elements 20 are, for example, spring-mounted on an unspecified swing arm, which in turn is pivotably movably attached to the rotor 10.

The tube segment used in the peristaltic pump is hereinafter referred to as the pump segment. On the base side, the tube segment not shown in FIG. 1 is not supported by the pump bed provided with the reference sign 7, but is held in a central position relative to the squeeze elements 20 by two guiding pins 70, 72 integrated in the swing arm (see FIG. 2). The support surface 30 is generally formed by a cylinder surface, but it can also be recessed in a trough shape. The rotational direction of the rotor 10 when conveying fluid is indicated by the arrow D.

Figure 2:
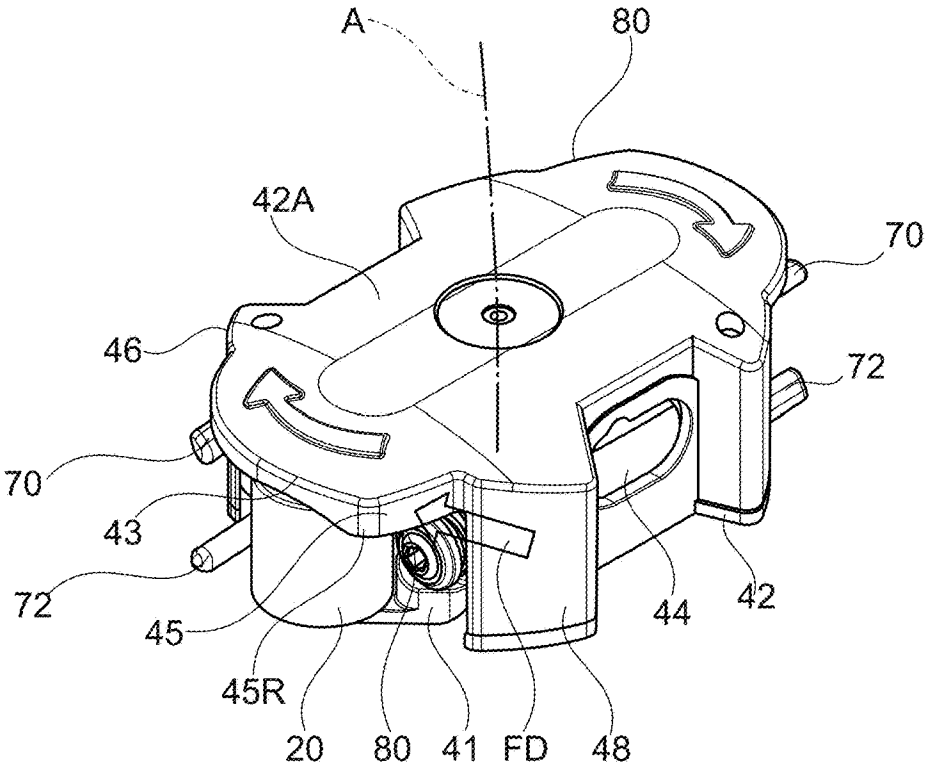
FIG. 2 shows a perspective view of a rotor used in the peristaltic pump according to FIG. 1.
Figure 5:
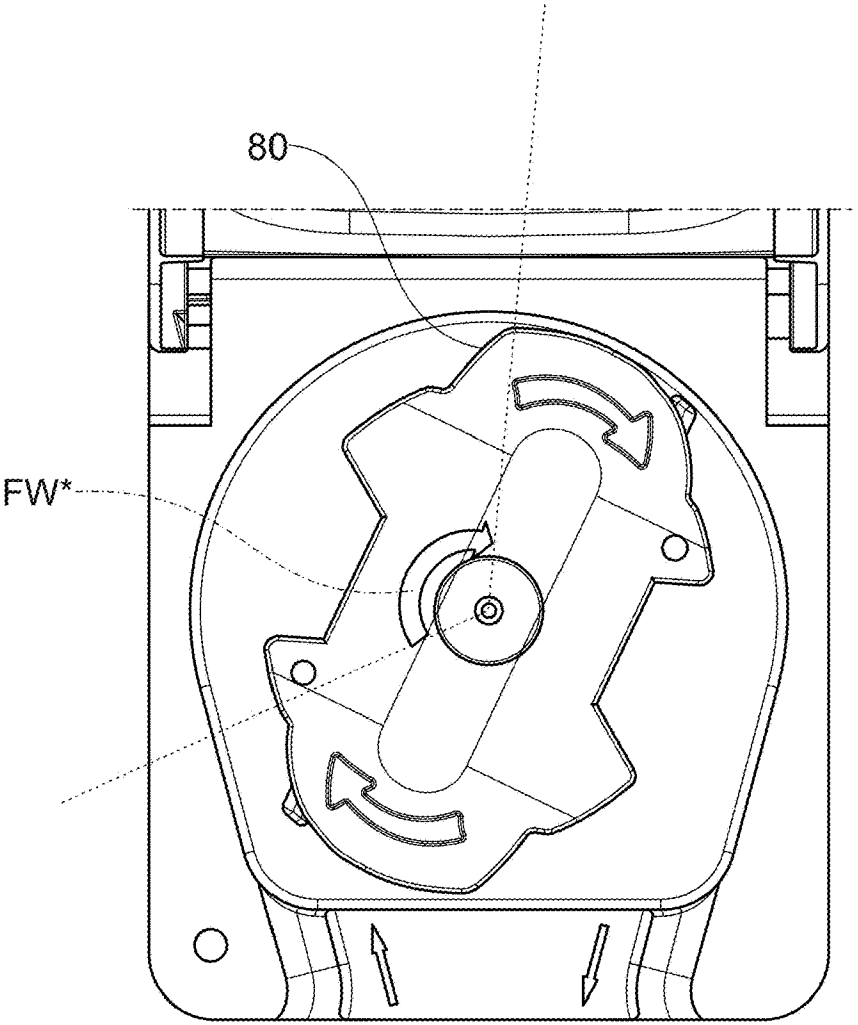
FIGS. 4 and 5 show top views of the peristaltic pump in various rotational positions of the rotor, in which squeeze-proof unthreading of the tube segment is possible.
Figure 4:
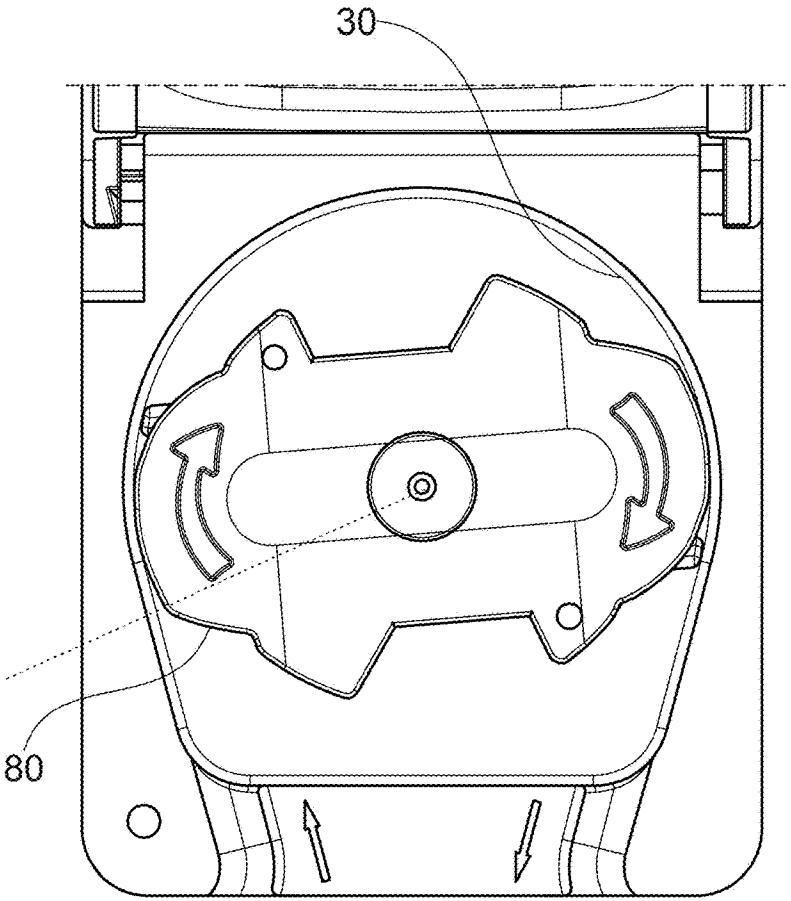

FIG. 2 shows details of the rotor 10. The rotor 10 has a rotor base body 42, not shown in detail, and a rotor cover 42A. The rotor 10 can be removed from a drive shaft, which is not shown in detail, by a laterally operable button 44. The squeeze elements 20 are rotatably mounted on a hinged swing arm 41 resiliently supported on the rotor base body 42.

Figure 3:
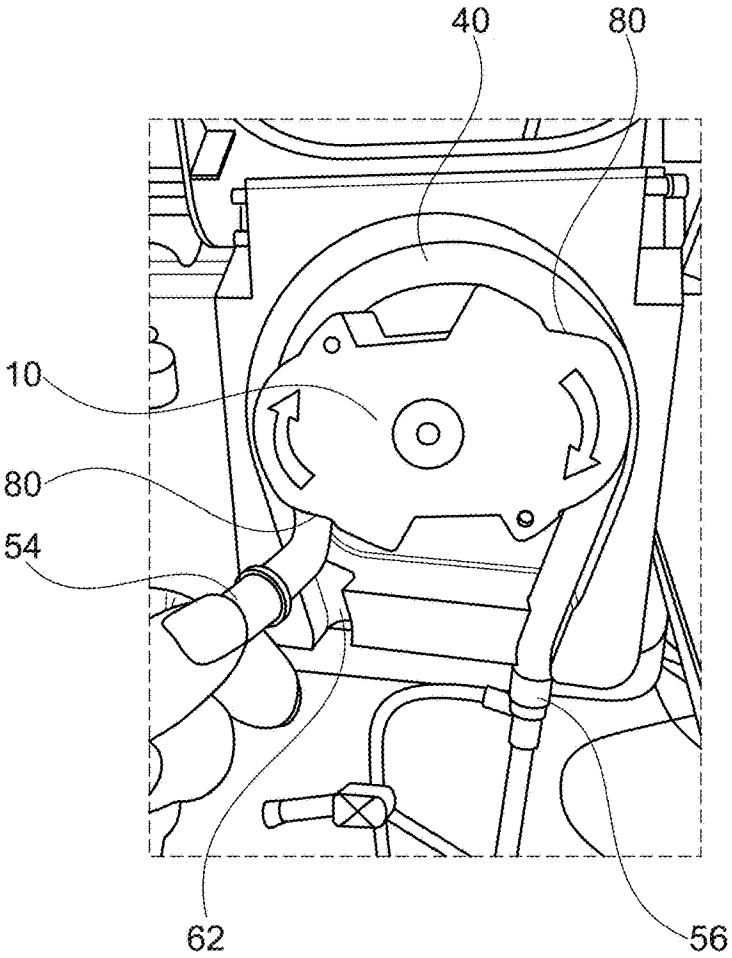
FIG. 3 shows a schematic view of the peristaltic pump unthreading a tube segment from the pump bed.

The rotor cover 42A co-rotating with the rotor 10 carries guide surfaces 46, 48 in the area of the squeeze elements 20, of which one guide surface 46 runs before the squeeze element 20 and the other guide surface 48 runs after the squeeze element 20. Accordingly, the guide surfaces 46, 48 are arranged and configured adjacent to both sides of the squeeze element 20 in the circumferential direction in such a way that—as can be seen from FIGS. 3—they each form a circular segment-like guiding passage FK1 and FK2 with the support surface 30, in which the tube segment 40 inserted into the pump bed 7, which is also referred to as the pump segment, is radially trapped with a predetermined clearance fit. FIG. 3 shows that the pump segment 40 is fixed to the pump housing 5 during operation of the peristaltic pump via two fitting bodies 54, 56, which can be fixed to terminals 62, 64 of the pump housing 5 so as to prevent displacement.

As can be seen from the representation according to FIG. 2, the rotor cover 42, i.e. a part connected to the rotor 10 in a rotationally fixed manner, has a sliding edge 80, which is arranged adjacent to the respective squeeze element 20 counter to the rotational direction D of the rotor 10 and extends toward the support surface, wherein the inserted tube segment, i.e. the pump segment 40, engages under the sliding edge 80—as can be seen from FIG. 3—so that the sliding edge is gripped from below or under reached by the pump segment.

If the pump segment 40 is to be unthreaded, the fitting body 54 located on the low-pressure side PN is detached from the pump housing 5 and pulled upward from the pump bed 7—as shown in FIG. 3. The rotor 10 is to assume the rotational position or pose shown in FIG. 3. Since the pump segment 40 under reaches or engages under the sliding edge 80, the pump segment 40—when it is pulled upward as shown in FIG. 3—touches the sliding edge 80 in an upward curved state, so that the contact force has a force component directed in the rotational direction D of the rotor 10, which is indicated by the arrow FD in FIG. 2. If the pump segment 40 is to be unthreaded, a small manually applied tensile force is sufficient to turn the rotor 10 in the direction of arrow D and successively release the pump segment 40 so that it can be pulled out of the pump bed. The tensile and contact forces acting on the pump segment 40 remain relatively limited in this way, which benefits the durability of the tube segment.

In order to put as little additional stress as possible on the pump segment 40, the sliding edge 80 is made of and/or coated with a material that has abrasion-minimizing sliding properties.

In the configuration example shown, the sliding edge 80 is located between the pinch roller, i.e. the squeeze element 20, and the guide surface 48 running after it in the rotational direction, i.e. in the immediate vicinity of the squeeze element 20. This assembly results in that the area in which the rotor 10 has to be located during manual unthreading in order to avoid clamping of the pump segment 40 is significantly larger than in known peristaltic pumps. The rotor 10 has to be in a position between the position 1 shown in FIG. 4 and the position 2 shown in FIG. 5, which are separated from each other by the angle of rotation FW*, which is in the order of 120 to 130°. This makes manual unthreading by the operator considerably easier, since they no longer have to pay increased attention to the position of the rotor 10.

Figure 7:
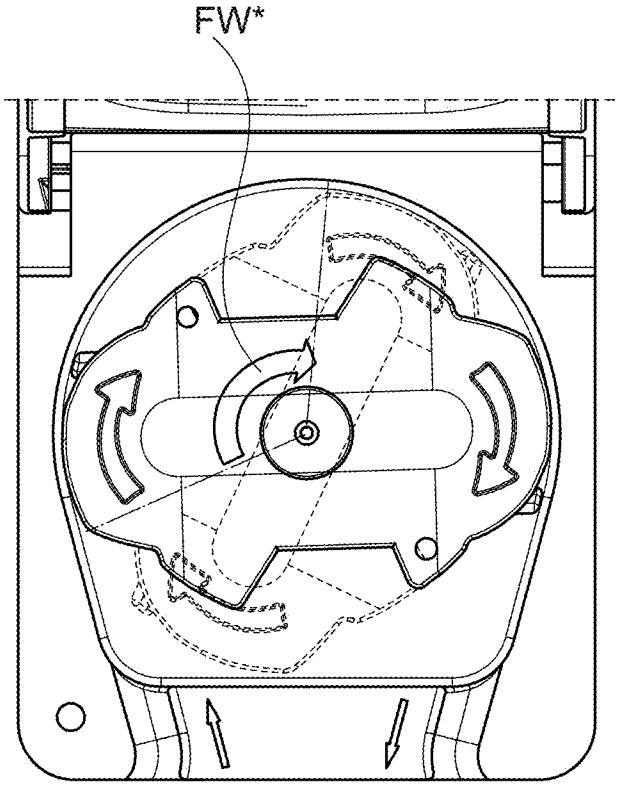
FIG. 7 shows a view corresponding to FIG. 6 of an embodiment according to the innovation of the peristaltic pump.
Figure 6:
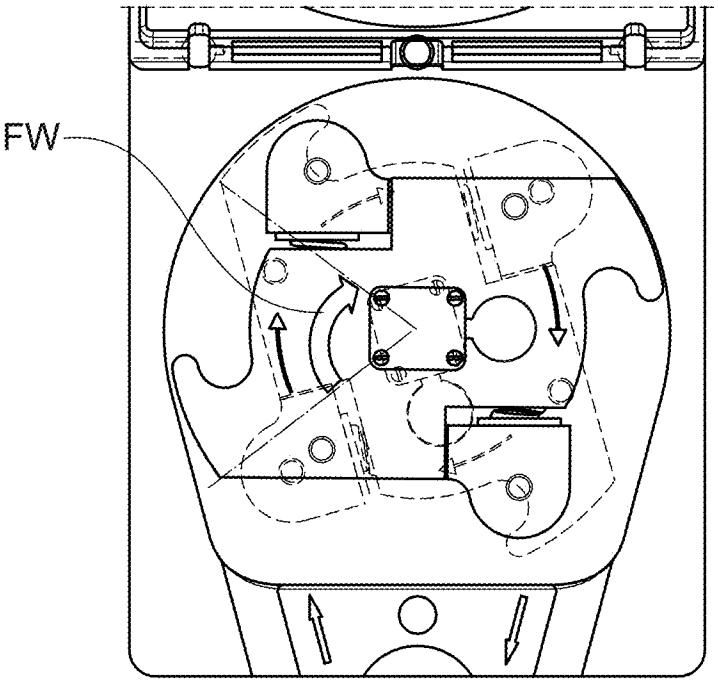
FIG. 6 shows a schematic view of a known generic peristaltic pump to illustrate the rotational position window for safe unthreading of the tube segment.
Figure 11:
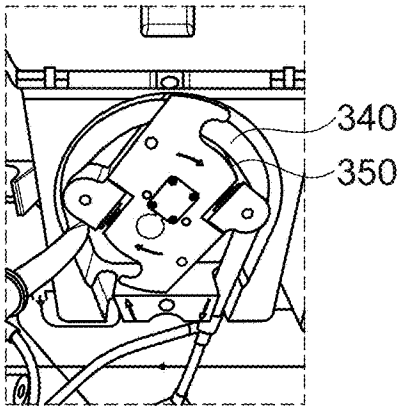
Fig. 11 (Prior Art)
FIG. 11 shows a schematic view of the known peristaltic pump with the rotor in an unfavorable rotational position for unthreading.
Figure 10:
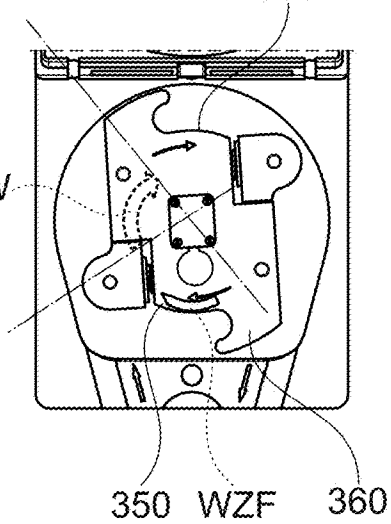
Fig. 10 (Prior Art)
FIGS. 9 and 10 show top views of a known peristaltic pump in various rotational positions of the rotor, in which unthreading of the tube segment is recommended.
Figure 9:
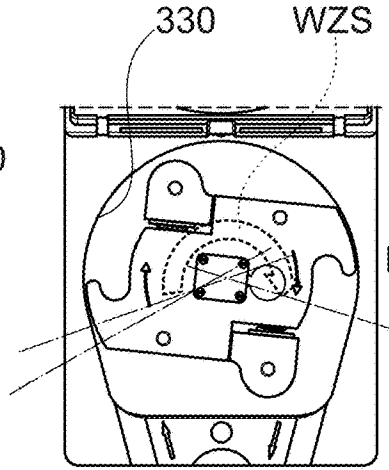
Fig. 9 (Prior Art)
Figure 8:
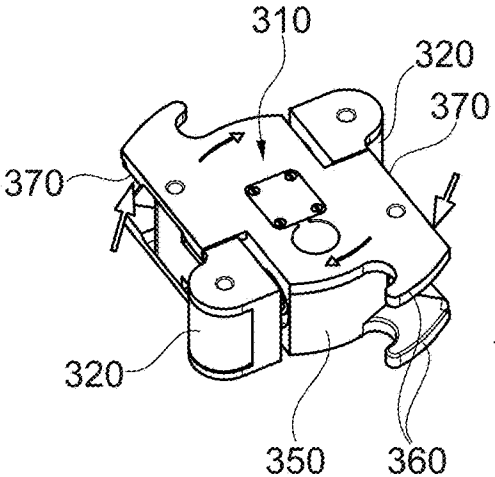
Fig. 8 (Prior Art)
FIG. 8 shows a perspective view of a rotor of a known peristaltic pump.

FIGS. 6 and 7 show the rotational positions between which the rotor 310 in the prior art and the rotor 10 in the embodiment according to the application have to be located for easy unthreading of the pump segment 40 or 340. FIG. 6 shows the known rotor 310 with both limit rotational positions, FIG. 7 shows the rotor 10 according to the application. In a first rotational position, the rotor is shown with solid lines, in the second limit rotational position with dashed lines. It can be seen that the permitted angle window FW can be considerably extended to the value FW* with the positioning and configuration of the sliding edge 80 according to the application.

The function of the sliding edge 80 is always fulfilled if it is formed or attached to a component of the peristaltic pump that is connected to the rotor 10 in a rotationally fixed manner. In the configuration example shown, this component is formed by the rotor cover 42, which has a cover plate 43 that overlaps the squeeze elements 20. FIG. 2 shows that the cover plate 43 thickens in the circumferential direction against the rotational direction D to form the sliding edge 80, whereby the sliding edge 80 is displaced closer toward the pump bed 7. This thickening can be realized, for example, by the cover plate 43—as best shown in FIG. 2—having an angled border bar 45 to form the sliding edge 80. At its radially outermost end 45R, the border bar 45 merges into a circumferential edge portion, the height of which gradually decreases toward the squeeze element 20.

Of course, deviations from the configuration example described are possible without departing from the basic idea of the present disclosure.

The sliding edge 80 may also be a component of a rotor body or a swing arm connected to the rotor 10 and carrying the squeeze elements.

In the peristaltic pump described above, two squeeze elements are provided which are rigidly arranged in a relative position of 180° or at a fixed angle of 180° to each other. However, it is also possible that more than two squeeze elements are provided and that the squeeze elements may be angularly positioned relative to each other in the direction of rotation. For this purpose, the squeeze elements may be arranged on rotor arms, which may be configured to pivot in the circumferential direction relative to the rotor.

The squeeze elements do not have to be configured as squeeze rollers or pinch rollers, which roll along the fluid line in an advantageous way that protects the material. Sliding shoes that glide over the tube segment may also be provided.

The present disclosure thus creates a peristaltic pump, in particular for conveying fluid in a device for extracorporeal blood treatment, with a pump housing in which a rotor rotatable about a rotor axis with at least two squeeze elements offset in a circumferential direction to each other is accommodated and which has a support surface extending arc-shaped about the rotor axis and spaced radially from the rotor, wherein the support surface is configured to support a tube segment which can be inserted radially between the rotor and the support surface. In order to simplify manual unthreading of the tube segment, the peristaltic pump has a sliding edge which is arranged adjacent to the respective squeeze element against the rotational direction of the rotor, extends toward the support surface, is connected to the rotor in a rotationally fixed manner and can be gripped from below or is under reached, resp., by the inserted tube segment.

LIST OF REFERENCE SIGNS

A rotor axis
WZF centering angle of the guide surface
D rotational direction
PN low-pressure side
PP high-pressure side
FW, FW* angle window
FD force component in rotational direction
5 pump housing
7 pump bed
10 rotor
20 squeeze element
30 support surface
40 pump segment
42 rotor base body
42A rotor cover
43 cover plate
44 button
45 border bar
46 guide surface
48 guide surface
54, 56 fitting body
62, 64 terminals
70 upper guiding pin
72 lower guiding pin
80 sliding edge
310 rotor
320 squeeze elements
330 support surface
340 pump segment
350 guide surface
360 guiding projections
370 edges

The invention claimed is:

1. A peristaltic pump for conveying fluid in a device for extracorporeal blood treatment, the peristaltic pump comprising:

a pump housing in which a rotor rotatable about a rotor axis with at least two squeeze elements offset in a circumferential direction to each other is accommodated and which has a support surface extending arc-shaped about the rotor axis and spaced radially from the rotor, wherein the support surface is configured to support a tube segment inserted radially between the rotor and the support surface; and a sliding edge which is arranged adjacent to a respective squeeze element and behind the respective squeeze element with respect to a forward rotational direction of the rotor, extends toward the support surface, is connected to the rotor to rotate about the rotor axis with the rotor, and is configured to be gripped from below or is under reached by the tube segment, wherein the sliding edge is located closer to the respective squeeze element than to a nearest adjacent squeeze element located behind the sliding edge with respect to the forward rotational direction of the rotor, wherein each sliding edge is a component overlapping the at least two squeeze elements.

2. The peristaltic pump according to claim 1, wherein each sliding edge is a component of a rotor body, or of a swing arm connected to the rotor in a rotationally fixed manner or of a rotor cover with a cover plate.

3. The peristaltic pump according to claim 2, wherein the cover plate increases in thickness in the circumferential direction against the forward rotational direction to form each sliding edge.

4. The peristaltic pump according to claim 3, wherein the cover plate has an angled border bar to form each sliding edge.

5. The peristaltic pump according to claim 4, wherein the angled border bar has a radially outermost end that merges into a circumferential edge portion, the circumferential edge portion having a height that gradually decreases toward the respective squeeze element.

6. A peristaltic pump for conveying fluid in a device for extracorporeal blood treatment, the peristaltic pump comprising:

a pump housing having a bed surface and a support surface extending from the bed surface, the support surface comprising an arc shape surrounding a rotation axis; and a rotor mounted to the pump housing to rotate about the rotation axis, the rotor comprising:

a plurality of squeeze elements offset to each other in a circumferential direction about the rotation axis and extending away from the rotation axis; and a plurality of sliding edges, wherein each sliding edge:

is arranged adjacent to a respective squeeze element and behind the respective squeeze element with respect to a forward rotational direction of the rotor, extends away from the rotation axis, and is spaced from the bed surface such that a tube segment located between the respective squeeze element and the support surface is located between the sliding edge and the bed surface;

wherein each sliding edge is located closer to the respective squeeze element than to a nearest adjacent squeeze element located behind the sliding edge with respect to the forward rotational direction of the rotor, wherein each sliding edge is a component overlapping the at least two squeeze elements.

7. The peristaltic pump according to claim 6, wherein the rotor comprises a plurality of cover plate portions, wherein each cover plate portion extends towards the support surface from the rotation axis with a respective squeeze element located between a respective cover plate portion and the bed surface, and wherein each sliding edge is located at a trailing edge, with respect to the forward rotational direction of the rotor, of a respective cover plate portion.

8. The peristaltic pump according to claim 6, wherein each cover plate portion has a first thickness along the rotation axis, and each sliding edge has a second thickness along the rotation axis, and the second thickness is greater than the first thickness.

9. The peristaltic pump according to claim 8, wherein the first thickness gradually increases to the second thickness.

10. The peristaltic pump according to claim 6, wherein each sliding edge is a component of a swing arm pivotally connecting a respective squeeze element to the rotor.

* * * * *